United States Patent [19]

Lenz

[11] Patent Number: 5,027,685

[45] Date of Patent: Jul. 2, 1991

[54] WOODWIND INSTRUMENT

[76] Inventor: Frederick C. Lenz, R.D. #1, Box 13, Spring Creek, Pa. 16436

[21] Appl. No.: 444,987

[22] Filed: Dec. 4, 1989

[51] Int. Cl.[5] ..... G10D 9/04

[52] U.S. Cl. ..... 84/330; 84/385 P

[58] Field of Search ..... 84/330, 380, 384, 385 P

[56] References Cited

U.S. PATENT DOCUMENTS

| | | | |
|---|---|---|---|
| 2,146,179 | 2/1939 | Fitchhorn | 84/330 |
| 2,214,314 | 9/1940 | Tillery | 84/330 |
| 2,619,865 | 12/1952 | Lynch | 84/330 |
| 3,191,481 | 6/1965 | Miller | 84/380 |
| 3,375,746 | 9/1968 | Proll | 84/380 |
| 3,398,624 | 8/1968 | Stoessel et al. | 84/330 |
| 4,114,501 | 9/1978 | Tanaka | 84/330 |
| 4,401,007 | 8/1983 | Lewis | 84/380 |

FOREIGN PATENT DOCUMENTS

| | | | |
|---|---|---|---|
| 1486562 | 9/1977 | United Kingdom | 84/330 |

*Primary Examiner*—Lawrence R. Franklin

*Attorney, Agent, or Firm*—Charles L. Lovercheck; Wayne L. Lovercheck; Dale R. Lovercheck

[57] ABSTRACT

A simple form of woodwind instrument of the clarinet-type and flute-type is shown. Each instrument utilizes the same body made of PCV pipe and different sound generators of clarinet-type mouth pieces or flute-type head joints designed to fit the body. The instrument is intended for beginners in a general music classroom setting grades 1 through 6, possibly complementing the "Orff instrumentarium" of percussion instruments. The simplified instrument may be used along to provide "hands-on" introduction to the legitimate woodwind instruments (clarinets and flutes) in a step-by-step preparation for playing these instruments.

2 Claims, 3 Drawing Sheets

WOODWIND INSTRUMENT

BACKGROUND OF THE INVENTION

Conventional clarinets and flutes are comprised of complicated mechanisms, usually too intricate for the very young (i.e. kindergartners, five years old) to hold and manipulate. Although this young age is ideally suited for introduction to instrument playing, heretofore, it has not been practical to implement the actual introductory learning and "hands-on" experience to legitimate woodwind instruments. So-called flutophones, recorders or tonettes cannot accomplish the same introduction since their mouthpiece fails to develop embouchure, back pressure or resistance, and lacks authentic tone quality, making its more typical recorder sound.

Drop-out rate in the United States is 50 percent for beginners on band and orchestra instruments. Even in school systems using pre-band/orchestra programs, the rate is very high. A well-thought-out graduated program of instruction could dramatically reduce this drop-out problem. A larger number of children would then be able to participate in the instrumental music program.

Essential performance skills of musical education develop at an early age and in a gradual, logical progression, such as embouchure development, back pressure resistance, breath support, intonation, legitimate sound (tone quality), tonguing skills (articulation) and cooperative band/orchestra experience.

STATEMENT OF THE INVENTION

The greatly simplified wind instrument consists of a tubular body, of PVC-like material, of a pre-designated length, producing a singular scale tone by means of a clarinet-type mouthpiece or flute-type head joint, which are uniquely designed as integral sound generators in utilizing the instrument. Said instruments are intended for use in multiples, two or more sounding concurrently, producing melodic or harmonic tones. Therefore, classroom use constitutes the ideal environment for employing instrument sets, representative of various scale tones, each individual playing one note of childrens' familiar melodic or harmonic song parts.

The instrument according to the invention, can be compared to conventional group instrumentarium, such as hand-held tone bells, wherein each individual is assigned a scalic note within the music framework. With the instrument according to the invention, a rudimentary introduction to woodwind-playing technique is afforded, developing correct embouchure or lip and tongue placement, as well as producing legitimate clarinet-like and flute-like tone quality and sound.

The instruments according to this invention are "flute-like" and "clarinet-like" in that they generate a vibrating column of air in the standard manner, therefore producing the characteristic clarinet and flute sounds. Each pipe's pitch will be a color, number and letter coded member of the scale with the additional pitches F# and Bb. The system disclosed proposes that each student owns a personal clarinet mouthpiece and/or flute headjoint, which fit the school-owned instrumentariums. The headjoint and mouthpiece are provided at minimal cost to the student. The music is coded by color, number and letter using iconic notation.

In using out the invention, each student produces an individual pitch contributing to the melody or accompaniment of a song, used to accompany singing or as an entity in itself. Grades 1 and 2 could use the instrumentarium as a logical "stepping stone" to the fingered instruments described later herein.

Low cost of manufacture is of prime consideration, providing every beginner an easily affordable, yet pedagogically sound, introductory instrument, combined with a vital ensemble experience.

In brief outline, the beginner follows a special music symbol notation, employing various horizontal bar lengths, or icons, representative of tone duration, and such bars being color-coded to correspond with the note of the scale and appropriately-colored pipe.

Variations of the instrument according to the invention are intended as progressive stepping-stones toward playing standard clarinets and flutes and encompass various second stage simplified wind instruments. While ideally suited as a second stage wind instrument, the instruments according to the invention variations are by no means limited to such a progression and can be employed as a pre-standard clarinet and/or flute introduction on its own.

The inventions consist of a tubular body as in the flute-like design, with the optional addition of a slightly flared bell resembling clarinet-like design. The aforementioned integral mouthpiece and head joint designs of the instrument according to the invention sets continue as sound generators, but the changed body design results in a more advanced "tutor" for aspiring clarinet and flute players, while maintaining the highly desirable characteristic features of the instrument according to the invention of low production cost and retail cost and longstanding durability.

The principal design changes include providing finger holes and two unique plastic keys transforming the embodiment into a fingered, keyed, wind instrument, based on a scale, that is, in musical terms, using the eight standard tones of a major scale, without chromatic variations, with the exception, in this case, of the additional A#/Bb tone to facilitate the playing of many songs. Retaining the basic criterion of simplicity and economy, the invention develops the student's fingering positions and patterns, using a simplified system, allowing concentration on a basic scale pattern, as described, so that familiar childrens' songs can be quickly learned, spurring on encouragement, hence progress. Since the PVC-like instrument material and plastic-like key material maintain a low cost, the young student can afford to purchase a clarinet-like and/or flute-like wind instrument reproducing authentic tone quality, reinforcing proper embouchure technique, instilling coordination of breathing, tonguing, and fingering skills, and duplicating the wind resistance encountered while playing standard clarinets and flutes. A closely related advantage of low-cost PVC-like material is its durability and ready access, clearly conducive for juvenile usage.

Classroom environments provide ideally-suited opportunities to employ clarinet-like and flute-like student programs, since melody and harmony parts blend in limitless combinations, along with singing, for a total participation. By basing student musical notation on well-known curriculum-derived childrens' songs, progress accelerates through such familiarity and ensemble experience. The special, simplified, musical notation herein continues to be as described for the instrument according to the invention, varying bar lengths or icons, properly positioned on the traditional five-lined, four-spaced treble clef staff, coding each pitch by color, number and letter to facilitate beginning note reading.

The resulting woodwind student program provides every youngster a low-cost opportunity for learning woodwind technique, preliminary assessment of musical abilities, and valuable insight when investing in standard wind instruments of choice. Having developed rudimentary abilities involving embouchure, breathing, fingering, back pressure or resistance, and intonation, coupled with reading the written language of music, its rhythm and pitch, combines to afford a most vital head-start to standard instrumental performance and even more necessary, self-motivation to continue instrumental music instruction. The unsurpassing combination of youthful early learning prowess and universally available, low-cost means can only achieve an expanded, enhanced, accelerated musical future.

Functionally, the keyless and hole-less tubular instrument is used to produce a single tone, eliminating every possible additional function such as fingering, and hand placement providing maximum concentration and focus of the student on vital fundamental embouchure development and tonal quality.

Simplification of the invention's design concerning key elimination and uniquely designed integral mouth pieces/head joints, provide the opportunity for simple manufacturing and assembling of this instrument. No other instrument which emphasizes traditional clarinet and/or flute embouchure and tone has been produced without considerable expense and technical assemblage.

The PVC-like material as used in the instrument according to the invention, greatly reduces manufacturing costs, since such material is inexpensive, readily available, and easily assembled. The PVC-like material, while maintaining a low cost of manufacturing, has a high degree of durability, simultaneously retaining a desirable lightness in weight, clear and distinct advantages for juvenile usage.

The "key" of this invention variation is shaped with a unique curved fulcrum-like center flared on one end to mount directly to the instrument's tubular body at two protrusions of the key and extends outward sufficiently at the opposing end to be reached with ease when finger pressure is to be applied downward.

The "key" structure is of plastic-like material incurring far less cost to manufacture than traditional keys of other material and more complicated design.

The mounting of the "key" structure differs from traditional mounting procedures in that posts, rods, or any other extrinsic supports are eliminated. The "key" mounting is achieved through the aforementioned end shape of the "key" fanning out in a radius to mate with the radius surface of the instrument body, including at least two stud protrusions on the flared radius of the "key", positioning and anchoring the "key" when mated to the body radius in receiving holes and secured with adhesion cement such as used with PVC-like material, resulting in a mounting of durable, simple and low-cost design.

The customary instrument key action derives its upward and downward flex through delicate flat or wire spring-loaded joints to be kept adjusted and periodically repaired, as necessary. The simplicity of reacting key structures with integral non-metallic spring-action results from utilization of inherent tensile strength of plastic-like resilient material with the aforementioned shape and design. When in the upward position, leaving the tone hole or port open, the rigidity inherent in the key material keeps the key above the instrument surface. After depressing the key with the finger, thereby closing and sealing off the tone hole, the key returns to its open position when released, effectively shortening the tonal length of the pipe to produce a higher pitch.

Clarinet and flute pads, as applied beneath the key, complete the essential airtight seal of closed holes or ports. In this invention in keeping with simple and economic design features, the necessary pad is thin adhesive-backed, foam-like material, seated directly over the hole when the key is in closed position, affording the requisite airtight seal through a low-cost, simply assembled, readily available, and durable alternative.

The usual tone hole or tone port construction includes a narrow raised lip or chimney at the hole's edge, either drawn up directly from the body material or added on by soldering or other means to create a flat ringed surface. This invention uses tone holes of the fife-type, ported directly into designated positions on the body, the hole edges being flush or level to the body surface. The "key" design, at its central fulcrum-like point includes a curved platform area, (underneath which the pad adheres), which mates convex surface to the instrument body's convex surface, eliminating the typical flat padded "key" seated over the usual raised-rim chimney, flat tone hole surface.

OBJECTS OF THE INVENTION

It is a general object of the instrumentarium invention to introduce authentic clarient-type and flute-type playing to entire music classes rather than a few select individuals.

It is a major object of this invention to reduce substantially the cost of manufacturing introductory wind instruments, thereby greatly reducing the subsequent cost to the beginning student.

Another object of the invention is to utilize sets of said instrumentarium within the classroom with students needing only to acquire their own personal mouthpiece and/or head joint for combined class practice.

Another object of the invention is to utilize mouthpieces of unique design without cork or O-ring tenon seal as is the standard practice. The PVC-like tenon mates securely with the PVC-like coupling mated to the pipe body.

Another object of the invention is to utilize head joints of unique design eliminating so-called end tuning corks, replacing them inexpensively with plastic button plugs and PVC pipe. Outside, it substitutes for the typical end crown of a flute head joint, and inside, it provides the necessary airtight seal, also being adjustable to fine tune.

Another object of the invention is to provide legitimate clarinet-like and flute-like instrumental playing experience and authentic sounding instruments for entire music classes rather than the relatively small percentage generally participating.

Another object of the invention is to reduce substantially the production cost and subsequent retail cost of introductory wind instruments, while maintaining mouthpieces and head joints requiring proper embouchure, finger holes/keys promoting requisite fingering patterns, and over-all instrument design establishing tonal integrity.

Another object of the invention is to utilize mouthpieces of unique design as in the instrument according to the invention without cork or O-ring tenon seal as in standard practice. PVC-like tenon mates securely with the PVC-like coupling part, whether it be a separate part or molded as an integral mouthpiece mating to the pipe body.

Another object of the invention is to utilize flute-like head joints of unique design as in the instrument according to the invention, eliminating so-called end tuning corks, replacing them inexpensively with plastic button plugs and PVC-like pipe substituting for the typical end cork of a flute head, providing the necessary airtight seal and serving as a fine tuner.

Another object of the invention is to provide a simplified, uniquely designed key structure.

Another object of the invention is to provide an inexpensive key of plastic-like material.

Another object of the invention is to provide a unique means for mounting said key structure to the instrument body.

Another object of the invention is to provide an integral spring action relying on the inherent design and intrinsic tensil strength of the plastic-like material to achieve the required spring action for opening/closing (covering/uncovering) of tone holes or ports.

Another object of the invention is to provide a low-cost, readily available key pad ideally suited for the redesigned key shape, securing said pad to obtain an airtight seal over tone holes or ports when in the closed position.

Another object of the invention is to eliminate the standard raised rims or chimney around tone holes or ports, rather shaping the key's center to mate flush to the tubular instrument body to achieve an airtight seal.

Another object of the invention is to provide shortened variations of both clarient-like and flute-like instruments to accommodate young beginners who cannot reach finger holes and keys correctly positioned on standard clarinets and flutes.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

DETAILED DESCRIPTION OF THE DRAWINGS

Figure 1:
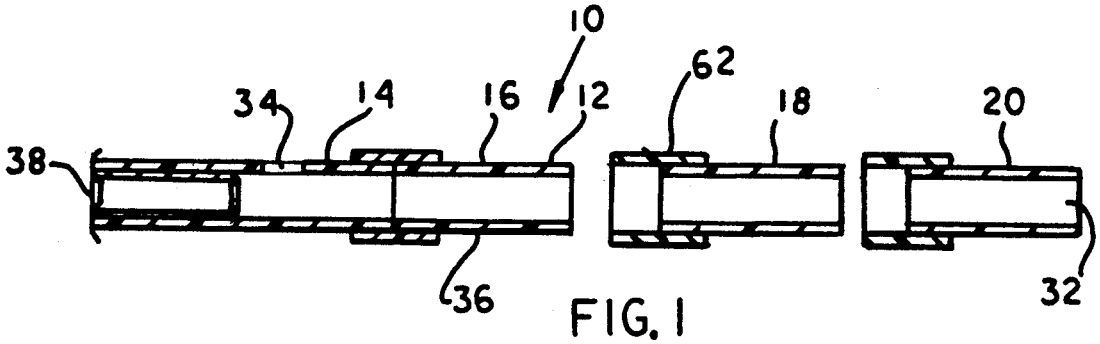
FIG. 1 is a longitudinal cross sectional view of a flute-type instrument according to the invention.

Now with more particular reference to the drawings, an instrument, according to the invention, is shown in FIG. 1 made up of flute type head joint 14, first pipe section 16, second pipe section 18 and third pipe section 20. The pipe used may be standard three-fourth inch diameter pipe. Head joint 14 has blow slot 34 of a conventional type and closed end 38. First pipe section 16, second pipe section 18 and third pipe section 20 are connected together and connected to head joint 14 by standard ¾" plastic couplings 62. Third pipe section 20 has open end 32. First pipe section 16, second pipe section 18 and third pipe section 20 are of a selected length such that with all of lengths a first note can be played. With second pipe section 18 removed a second note can be played and with third pipe section 20 removed a third note can be played. With first pipe section 16 alone connected to head joint 14 another single note of the scale could be played.

Flute-type instrument 10 of FIG. 1 is played in a transverse manner by blowing across blow slot 34, which is centered 17.3 millimeters from closed end 38. Blow slot 34 may be bored straight into the pipe with a plain straight side wall.

Figure 2:
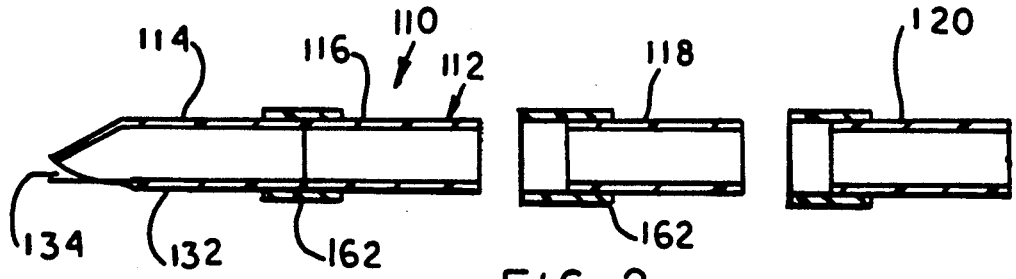
FIG. 2 is a longitudinal cross sectional view of a clarinet-type instrument according to the invention.

In the embodiment shown in FIG. 2, clarinet-type instrument 110 may be made of PVC polyvinylchloride body 116. Clarinet head section 114 has first slot opening 134. First pipe section 116, second pipe section 118 and third pipe section 120 may be connected together by coupling 162. Clarinet reed 132 is provided.

Figure 3:
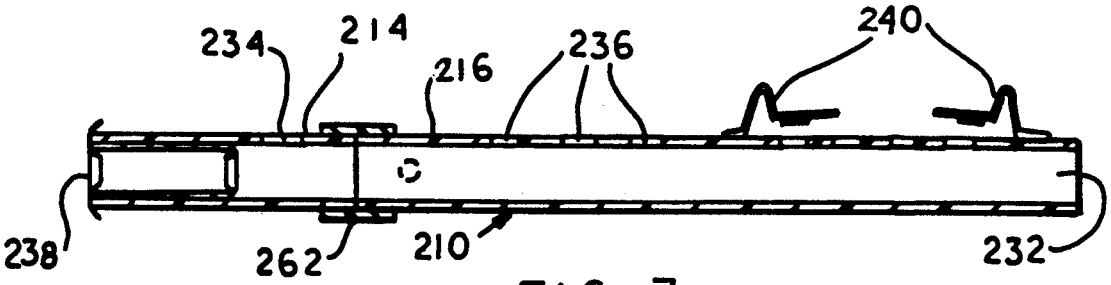
FIG. 3 is a view similar to FIG. 1 of another embodiment of the invention showing keys used on the instrument, with additional tone holes.

FIG. 3 shows an instrument, like FIG. 1, with flute-like head joint 214 connected to pipe section 216 by coupling 262. Pipe section 216 may have holes 236 bored therein and keys 40 are attached to pipe section 216 to open and close holes 236. Thus, each key 40 makes it possible to play an additional note on the instrument. Keys 40, shown in FIGS. 3, 4, 7 and 8 can be used for reaching c and f. The location of holes will determine the note to be played.

Figure 4:
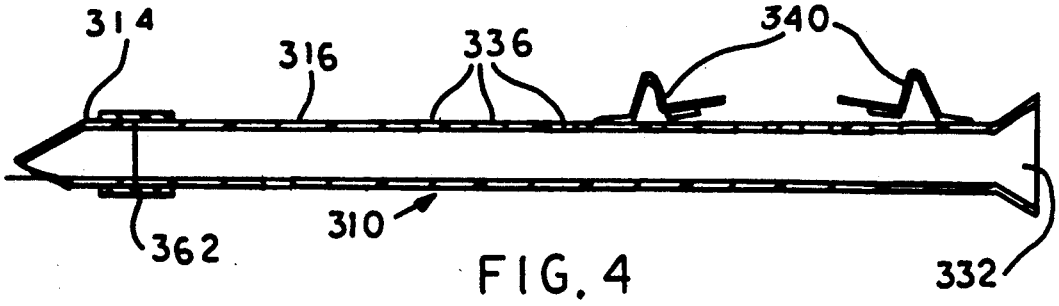
FIG. 4 is a view, similar to FIG. 2, of another embodiment of the invention, showing keys used on the instrument with additional tone holes.

FIG. 4 shows an instrument, like FIG. 2, with clarinet-like mouthpiece 314, using reed 132, connected to pipe section 316 connected together by coupling 362. Pipe section 316 may also have holes 336 bored therein and keys 40 are attached to pipe section 316 to open and close holes 336. Thus, each key 40 makes it possible to play an additional note on the instrument. Keys 40, shown in FIGS. 3 and 4, can be used for reaching c and f. The location of holes will determine the note played. Flared bell end 332 can be used.

Figure 5:
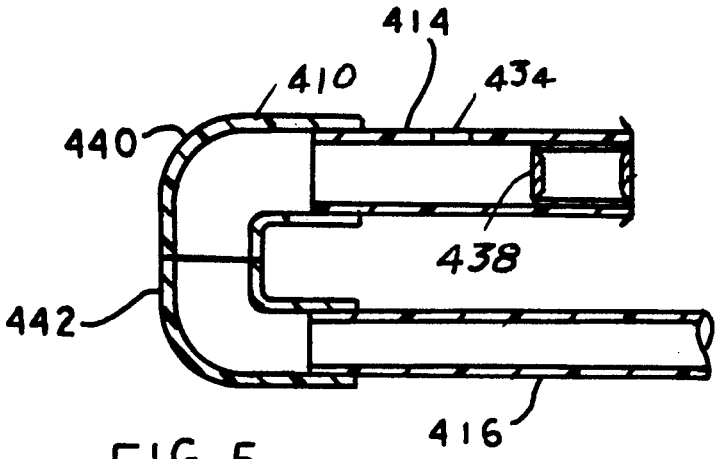
FIG. 5 is a view of another embodiment of the invention.
Figure 5A:
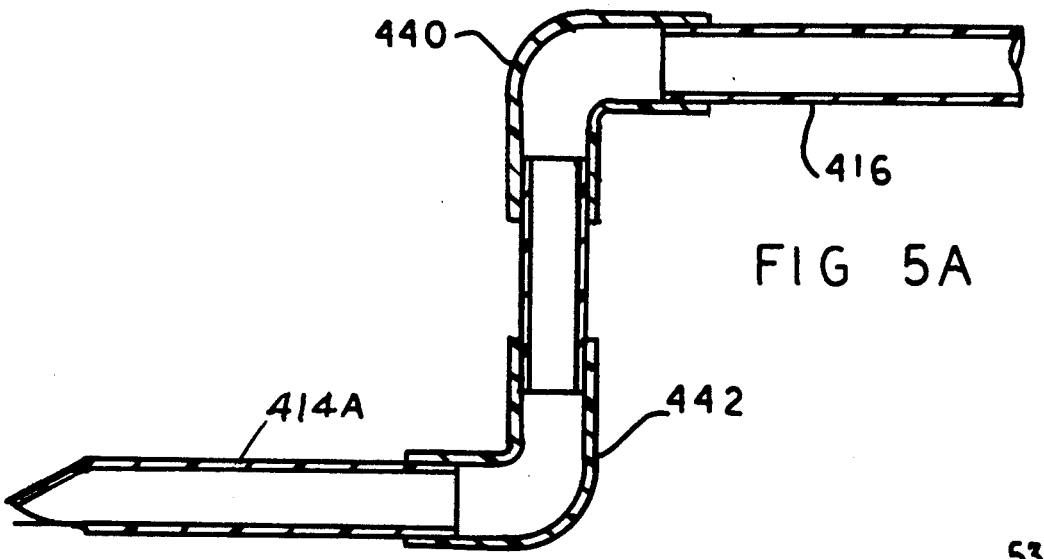
FIG. 5A is a cross sectional view of another embodiment of an instrument according to the invention.

FIGS. 5 and 5A show first pipe section (head joint 414 or 414A mouthpiece) and second pipe section 416 can be connected together by first elbow 440 and second elbow 442 to rearrange the length of pipe used without increasing the overall length of the instrument. Head joint 14, of FIG. 1, or mouthpiece 114 of FIG. 2, can be provided and one or more holes can be formed in pipe section 416 to produce one or more notes.

Flute 410 is played in transverse manner by blowing across hole 434 centered 17.3 millimeters from stopped end 438 of pipe 414. Flute 410 may be one length of pipe 24¼ inches or fitted with two ¾ inch 90° turns to return head joint 414 back over body 416 having the same over all length of 24¼ inches as flute 10.

Figure 6:
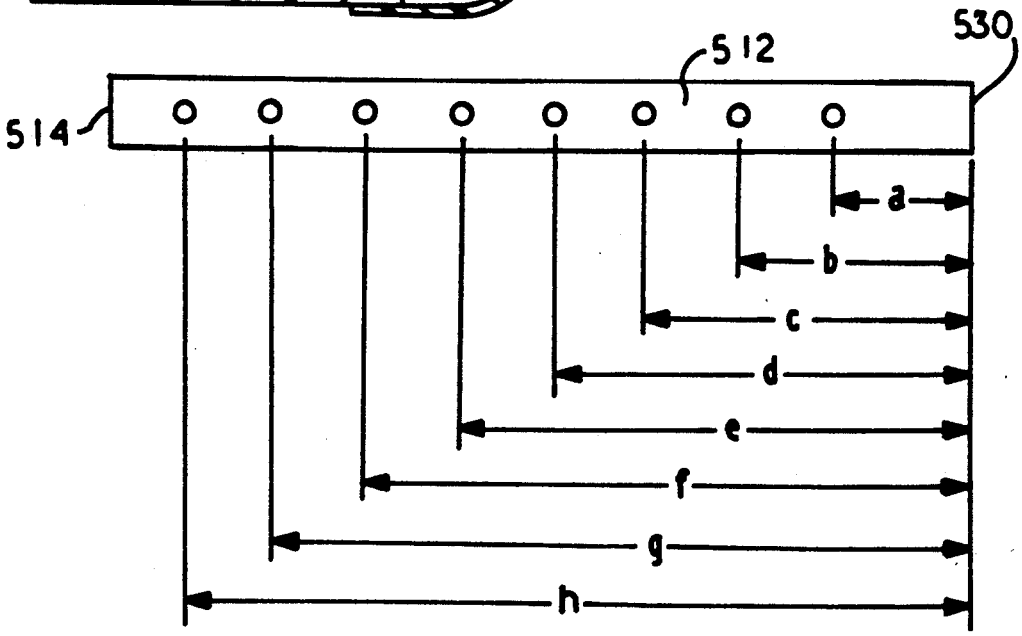
FIG. 6 is an enlarged top view of approximate hole placement of the invention.

Body pipe 512, shown in FIG. 6, may be a single straight length of ¾" pipe and may end in a flared bell, similar to flared bell 332 as shown in FIG. 4, and a suitable head joint length being approximately 24½" long or 24½" overall length. Pipe 512, made of a single piece of pipe, may have eight holes therein spaced from end 514 to produce the notes of a scale. Such spacing of the holes is shown from end 530 in approximate lengths as follows: a=3½"; b=6¼"; c=79/32"; d=95/16"; e=11¼"; f=12⅛"; g=12⅞"and h=13⅝".

Figure 7:
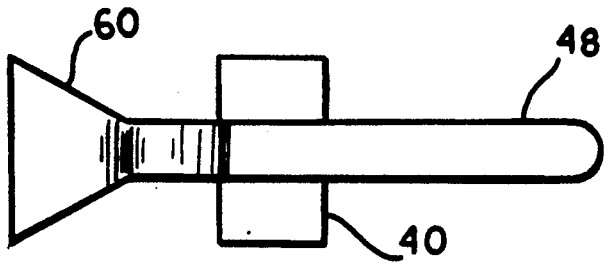
FIG. 7 is a top view of the key shown in FIGS. 3 and 4.
Figure 8:
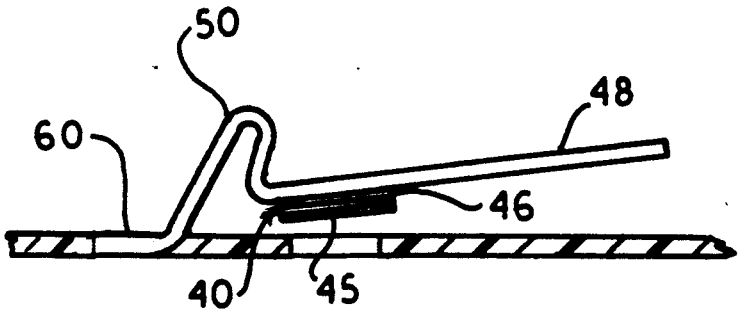
FIG. 8 is a side view of the key.

FIGS. 7 and 8 show enlarged views of key part 40, according to the invention, which has straight part 48, arched curved fulcrum part 50 and flared end member 60. Pads 45 and 46 are curved to conform to pipe 210 comprising the instrument and adapted to be attached to key part 40 by a suitable cement. Flared end member 60 is likewise curved to fit the contour of the instrument and center key part 40 may have pads 45 of resilient adhesive-backed foam-like material to provide an air-tight seal when pad 45 is depressed to a closed position. The PVC material, of which key part 40 is made, provides sufficient tensil strength to give arched curved fulcrum part 50 a spring action to open key part 40 when finger pressure is released.

Figure 9:
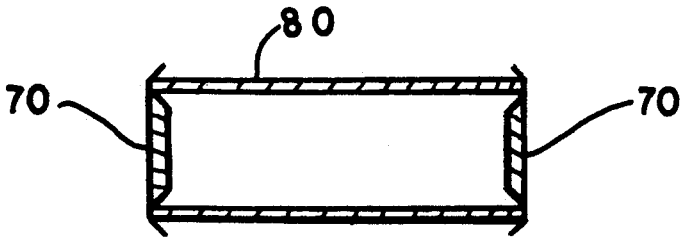
FIG. 9 shows an end cork, as in FIGS. 1 and 3, in greater detail.

FIG. 9 shows flute end tuning stopper 38, as in FIGS. 1 and 3. The center part consists of a length, approximately 1½ inches of PVC ½" I.D. pipe 80, stopped at both ends with plastic button plugs 70 to function as a fine tuner for flute-like instruments and replaces the crown and tuning cork on a typical flute head joint.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A tubular instrument comprising a hollow tubular body having ends and a tone hole between said ends, a one piece key means made of resilient material supported on said body between said ends adjacent said tone hole to close said tone hole when said key is depressed, said key means being fixed to said body adjacent said tone hole and extending from said instrument and terminating in a straight part overlying said tone hole, pad means on said key, finger engageable means on said key means to move said pad means to close said tone hole when pressure is exerted on said finger engagable means by a finger of a musician.

2. In combination a wind type instrument and a key, said instrument comprising a pipe having a first end and a second end, a mouth engaging part on said first end, a tone hole in said pipe between said first end and said second end, said key comprising one piece of resilient material having a first end and a second end, said first end of said key resting on said pipe adjacent said tone hole, attaching means for attaching said first end of said key to said pipe, said key extending from said first end of said key curving upward then downward toward said tone hole, said key having a straight part extending over said tone hole and having a sealing means attached to said straight part, said straight part being adapted to be engaged by a finger of a musician whereby said sealing means is moved to overlie said tone hole thereby closing said tone hole to produce a musical note.

* * * * *